US007010927B2

(12) United States Patent
Lifson et al.

(10) Patent No.: US 7,010,927 B2
(45) Date of Patent: Mar. 14, 2006

(54) REFRIGERANT SYSTEM WITH CONTROLLED REFRIGERANT CHARGE AMOUNT

(75) Inventors: Alexander Lifson, Manlius, NY (US); Michael F. Taras, Fayetteville, NY (US); Thomas J. Dobmeier, Phoenix, NY (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 10/703,909

(22) Filed: Nov. 7, 2003

(65) Prior Publication Data

US 2005/0097904 A1 May 12, 2005

(51) Int. Cl.
*F25B 45/00* (2006.01)
*F25B 41/00* (2006.01)

(52) U.S. Cl. ..... 62/149; 62/174; 62/292

(58) Field of Classification Search ..... 62/149, 62/174, 503, 509

See application file for complete search history.

(56) References Cited

U.S. PATENT DOCUMENTS 3,064,445 A * 11/1962 Gerteis ..... 62/174
3,844,131 A * 10/1974 Gianni et al. ..... 62/149
4,096,706 A * 6/1978 Beckwith ..... 62/115
4,841,739 A * 6/1989 Wallner ..... 62/174
4,876,859 A 10/1989 Kitamoto
5,477,697 A * 12/1995 Wharton et al. ..... 62/117
5,611,211 A * 3/1997 Whipple, III ..... 62/149
5,875,637 A 3/1999 Paetow
6,047,556 A 4/2000 Lifson
6,206,652 B1 3/2001 Caillat
6,539,735 B1 * 4/2003 Schmidt ..... 62/174

OTHER PUBLICATIONS

Systems & Advanced Technologies Engineering S.r.l., publication entitled "COMPSYS—Dynamic Simulation of Gas Compression Plants".

Copeland Application Guideline for Refrigeration Scroll for Parallel Applications.

* cited by examiner

*Primary Examiner*—Marc Norman
(74) *Attorney, Agent, or Firm*—Carlson, Gaskey & Olds

(57) ABSTRACT

An air conditioning system includes a supplemental storage container that allows for transferring refrigerant into or out of an air conditioning or refrigeration system based upon different operating conditions. In one example, a controller controls the operation of valves that selectively couple the storage container to the high pressure side or the low pressure side of the system. Depending on operating conditions, when it is desirable to increase an amount of refrigerant in the system, refrigerant is transferred from the storage container to the low pressure side of the air conditioning or refrigeration system. Under conditions where the amount of refrigerant in the system is above a desired amount, refrigerant can be transferred from the high side of air conditioning system to the storage container to bring the pressure within the system closer to the desired level.

21 Claims, 1 Drawing Sheet

REFRIGERANT SYSTEM WITH CONTROLLED REFRIGERANT CHARGE AMOUNT

FIELD OF THE INVENTION

This invention generally relates to air conditioning and refrigeration systems. More particularly, this invention relates to controlling an amount of refrigerant within an air conditioning or refrigeration system during operation to achieve desired optimal system performance.

DESCRIPTION OF THE RELATED

Air conditioning and refrigeration systems typically utilize a certain refrigerant charge within the system to achieve a desired amount of cooling within a building, for example. Having an adequate amount of refrigerant within the system is necessary to achieve a desired system operation and to prevent damage or malfunctioning of the system components.

If the air conditioning or refrigeration system has an insufficient amount of refrigerant, its cooling capacity is lower than expected and the desired temperature and humidity levels may not be achievable or the system has to operate for longer periods of time. Additionally, an expansion device may malfunction. If the system is overcharged, there is a decrease in efficiency, which in turn increases lifetime operating cost to the end customer. Furthermore, a number of start-stop cycles increases, thereby reducing system and component reliability and compromising temperature control. In some instances, overcharging may cause nuisance trips under high ambient temperature conditions, which reduces the system operating envelope and manifests itself in an entire loss of the system cooling capability by end users.

One shortcoming of conventional arrangements is that a given system will be charged with a specific refrigerant amount that corresponds to and is optimal for a single design point and does not correspond to an entire possible range of operating conditions under which a different refrigerant amount in the system would provide better performance and reliability.

There is a need for a way to optimize the amount of refrigerant within an air conditioning or refrigeration system to provide better system performance and reliability and avoid possible component damage and malfunction.

SUMMARY OF THE INVENTION

This invention allows selective control of the amount of refrigerant in a refrigerant system based upon a selected criteria such as operating conditions or required cooling capacity, for example.

One example system designed according to this invention includes at least one fluid conduit connected to a high pressure side of the air conditioning or refrigeration system. At least one fluid conduit is connected to a low pressure side of the system. At least one supplemental refrigerant storage container selectively receives refrigerant from the high pressure side or selectively provides refrigerant to the low pressure side.

In one example, the storage container is usually charged when the system is shut off, with the refrigerant at an intermediate pressure at the equilibrium conditions. Also, the container can be placed either in the indoor or outdoor compartment of the system.

In one example, a controller monitors system operation conditions such as pressures and temperatures measured directly or indirectly in the system and controls a transfer of refrigerant between the storage container and a selected one of the sides of the system. In one example, the controller determines at least one environmental condition, such as an ambient temperature, associated with the system and uses the determined environmental condition as a factor when controlling the refrigerant transfer.

One example system includes a pressure regulating device associated with the storage container for selectively controlling a pressure within the storage container. In one example, the pressure regulating device includes a heater.

A method of controlling an amount of refrigerant in an air conditioning system designed according to this invention includes providing at least one supplemental refrigerant storage container and selectively transferring refrigerant between the supplemental storage container and the system.

In one example, the method includes determining when a pressure within the system is above a desired level and transferring refrigerant from the system high pressure side to the storage container in an amount corresponding to bringing the pressure within the system closer to the desired level. In one example, when the pressure within the system is below a desired level, the method includes transferring refrigerant from the storage container to the system in an amount corresponding to bringing the pressure within the system closer to the desired level.

The various features and advantages of this invention will become apparent to those skilled in the art from the following description of the currently preferred embodiments. The drawings that accompany the detailed description can be described as follows.

DETAILED DESCRIPTION OF THE PREFERRED EMBODIMENT

Figure 1:
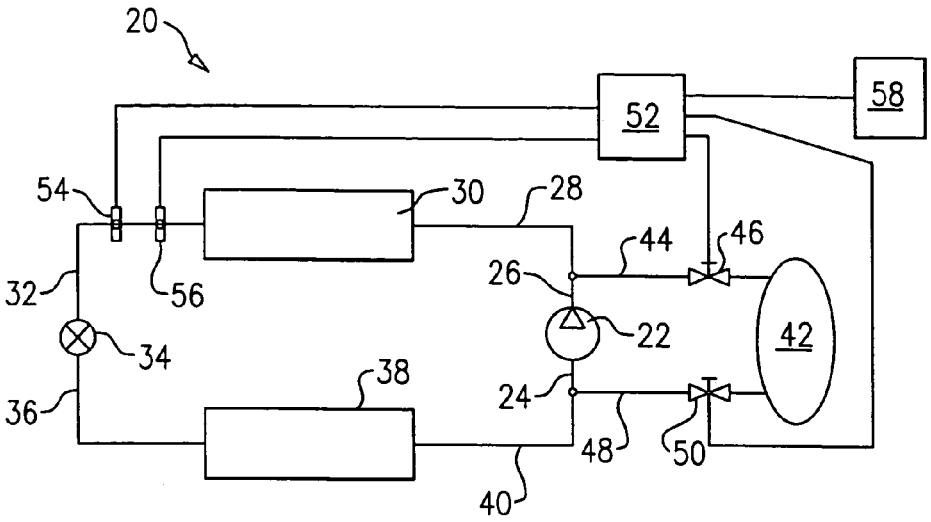
FIG. 1 schematically illustrates an air conditioning system incorporating a supplemental storage container that is useful for controlling an amount of refrigerant charge in the system.

FIG. 1 schematically shows a refrigerant system 20 that may be used as a refrigeration system or an air conditioning system. A compressor 22 draws coolant from a compressor suction port 24 and provides a compressed gas under pressure to a compressor discharge port 26. The high temperature, pressurized gas flows through a conduit 28 to a condenser 30 where the gas dissipates heat and typically condenses into a liquid as known. The liquid refrigerant flows through a conduit 32 to an expansion device 34.

In one example, the expansion device 34 is a valve that operates in a known manner to allow the liquid refrigerant to be expanded and to partially evaporate and flow into a conduit 36 in the form of a cold, low pressure refrigerant. This refrigerant then flows through an evaporator 38 where the refrigerant absorbs heat from air that flows across the evaporator coils, which provides cool air to the desired space as known. The refrigerant exiting the evaporator 38 flows through a conduit 40 to the suction port 24 of the compressor 22 where the cycle continues.

The system 20 has a high pressure side between the compressor discharge port 26 and an entrance to the expansion device 34. A low pressure side exists between the outlet of expansion device 34 and the suction port 24 of the compressor 22. In another example, an economizer loop functions in a known manner and constitutes an intermediate pressure side of the system.

The illustrated example includes a supplemental refrigerant storage container 42 that is selectively coupled to the air conditioning system. In this example, a first conduit 44 is arranged for selective fluid communication with the conduit 28. A valve 46 controls whether the storage container 42 is isolated from or in fluid communication with the conduit 28. Although the illustrated example includes a connection between the storage container 42 and the conduit 28, a connection with one or more other portions of the high pressure side of the air conditioning system may be used.

The storage container 42 is also selectively coupled with the low pressure side of the system through a connecting conduit 48. A valve 50 selectively controls any fluid communication between the low pressure side of the air conditioning system and the storage container 42. Similarly, multiple or different locations can be selected in the system low pressure side to be connected to the storage container 42.

A controller 52 controls operation of the valves 46 and 50 depending on the needs of a particular situation. In this example, the controller 52 utilizes information regarding pressure and temperature of the refrigerant at a particular location within the air conditioning system obtained from a pressure transducer 54 and a temperature transducer 56, which provide pressure and temperature information about the refrigerant within the system in a known manner. In this example, the pressure transducer 54 and the temperature sensor 56 are associated with the liquid line or conduit 32. Other sensor arrangements are within the scope of this invention. A number of pressure and temperature transducers utilized in the optimal charge determination method depends on the level of accuracy desired by the end user and may include pressure and temperature transducers on a system high side, low side or an intermediate side (e.g., an economizer loop). Given this description, those skilled in the art will be able to select an arrangement best suited to meet their particular needs.

The controller 52 also uses another operating condition associated with the system in this example. In the illustration of FIG. 1, a temperature sensor 58 provides ambient temperature information to the controller 52. The example controller uses predetermined relationships between ambient temperature and system pressure to decide whether any refrigerant transfer would be beneficial to optimize system performance. Accordingly, an operating condition, as used in this discussion, may be internal to the system or a condition that is external or environmental.

Another operating condition used by a controller 52 in at least one example embodiment includes information regarding any nuisance trips or shutdowns of the system resulting from an overcharged system (i.e., the system pressure is too high). In this example, if a selected number of system trips occurs within a selected time period, the controller may compare actual and anticipated system operating parameters and decide to transfer some refrigerant out of the system.

Depending on the current pressure within the system and an optimized desired pressure, which is based upon the selected operating condition associated with the system and the environment surrounding the system, the controller 52 selectively controls the valves 46 or 50 to allow refrigerant to be transferred between the storage container 42 and a selected side of the air conditioning system. For example, at a low ambient temperature additional subcooling and extra capacity are not needed and it may be desirable to safely remove some of the refrigerant from the air conditioning system, not compromising its functionality. Under such conditions, the controller 52 operates the valve 46 such that refrigerant is transferred from the high pressure side of the system to the storage container 42.

At elevated ambient temperatures, system capacity is critical for the customer to achieve the desired cooling level and it is important to avoid any malfunction of the expansion valve that may be associated with reduced subcooling. At some temperatures an additional refrigerant charge may be required or beneficial. In one example, the controller 52 controls operation of the valve 50 to transfer refrigerant from the storage container 42 to the low pressure side of the air conditioning system to address such a situation.

At some elevated ambient temperatures and reduced line voltages, the system may experience nuisance shutdowns, causing an entire loss of cooling capacity by the end users. In such circumstances, some refrigerant amount can be transferred from the system high pressure side to the storage container 42 in order to avoid undesired consequences.

The controller 52 in one example is programmed with previously determined relationships between the selected operating condition and a corresponding desired pressure within the air conditioning system. Based upon the current system pressure and the other operating conditions determined by the controller 52, a decision can be made whether to adjust the amount of refrigerant within the system by transferring refrigerant between the system and the storage container 42. Those skilled in the art who have the benefit of this description will realize which operating parameters to use and the appropriate pressure and operating condition relationships that will best meet the needs of their particular situation. Similarly, those skilled in the art who have had the benefit of this description will be able to suitably program a controller to perform the desired operations to achieve the refrigerant transfer scheme to meet their particular needs.

In one example, the controller 52 controls operation of the valves 46 and 50 in a pulsating manner to repeatedly open and close the valves during refrigerant transfer so that changes in system pressure occur in a controlled manner that will not cause any interruption in service or otherwise present any possible complications for the system components. In another example, the controller 52 modulates operation of the valves so that a steady, controlled refrigerant flow occurs during any transfer between the system and the storage container 42.

In one example, the storage container 42 comprises a canister that is capable of storing the selected refrigerant and withstanding pressures expected to result from any removal of refrigerant from the system. In one example, the storage container is initially at a vacuum. In another example, the storage container 42 is charged with refrigerant along with the air conditioning system at equilibrium conditions. In this example, when all the pressures are equalized, the refrigerant inside the storage container 42 is at the same pressure as the refrigerant in the system.

In another example, the storage container 42 is selectively charged higher or lower than the system equilibrium pressure. Those skilled in the art who have the benefit of this description will be able to select an appropriate initial charge amount within the storage container 42 to meet the needs of their particular situation.

During normal system operation, the low pressure side of the system typically will have a pressure that is below the refrigerant pressure within the storage container 42. The high pressure side of the air conditioning system typically will have a pressure that is above the refrigerant pressure within the storage container 42. These pressure differentials facilitate easy transfer of refrigerant between the storage container 42 and the air conditioning system as discussed above.

Figure 2:
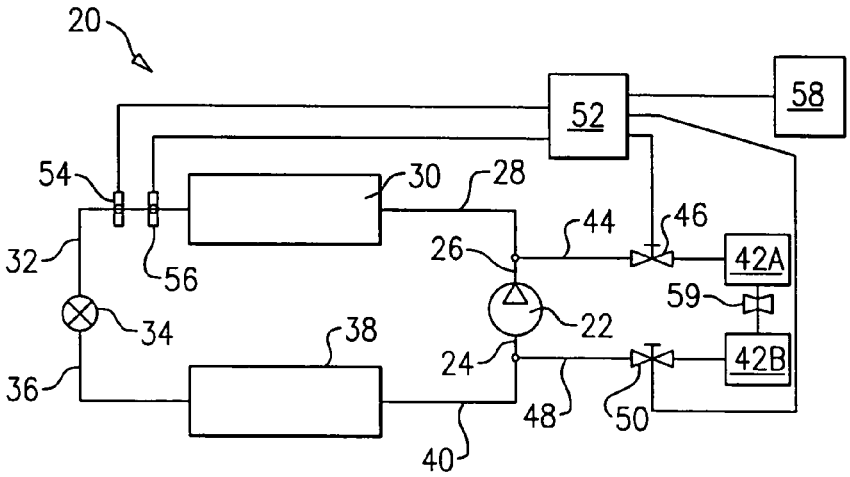
FIG. 2 schematically illustrates another example embodiment of this invention.

FIG. 2 illustrates an alternative embodiment compared to that shown in FIG. 1. In this example, individual storage portions 42A and 42B are associated with the high pressure side and low pressure side of the air conditioning system. In this example, the two storage containers 42A and 42B are selectively coupled together using a valve 59 that is controlled by the controller 52 to allow for refrigerant transfer between them as may be desired.

Figure 3:
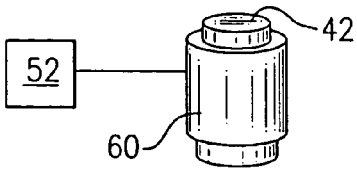
FIG. 3 schematically shows an example feature useful with either of the embodiments in FIGS. 1 and 2.

FIG. 3 schematically illustrates another feature of an example embodiment of this invention. In FIG. 3, the storage container 42 has a pressure regulating device 60 associated with it. The controller 52 controls operation of the pressure regulating device 60 to control refrigerant pressure within the container 42. In one example, the pressure regulating device includes an electric heating element that can be used to increase the temperature of the refrigerant within the storage container 42, which results in an increased pressure within the storage container 42. Such a pressure regulating device allows for controlling pressure within the storage container in a manner that facilitates transfer of refrigerant between the air conditioning system and the storage container to meet the needs of a particular situation.

The example embodiments of this invention allow for optimizing the amount of refrigerant in the air conditioning system and the overall system operation for a variety of environmental and operational conditions. Whenever a difference between the current system pressure and a desired pressure based upon the observed operating conditions is outside of a selected tolerance band, the amount of refrigerant in the system can be adjusted by transferring refrigerant between the storage container 42 and the selected side of the system. In one example, the tolerance band accounts for variations in transducer accuracy, transducer installations, the air conditioning system components and possible assembly for manufacturing variations. Those skilled in the art who have the benefit of this description will realize what factors are to be taken into consideration when developing an appropriate control scheme that dictates when refrigerant is transferred between the air conditioning system and the storage container.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A refrigerant system, comprising:

at least one fluid conduit on a high pressure side of the system;

at least one fluid conduit on a low pressure side of the system;

at least one supplemental refrigerant storage container that selectively receives refrigerant from or provides refrigerant to a selected side of the system; and a controller that determines at least one operating condition associated with the system and uses the determined operating condition for automatically controlling a transfer of refrigerant between the storage container and a selected one of the sides of the system, wherein the operating condition comprises at least one of an ambient temperature or an indoor temperature.

2. The system of claim 1, wherein the refrigerant is received or provided while the system is operating.

3. The system of claim 1, wherein the refrigerant is received or provided while the system is shutdown.

4. The system of claim 1, wherein the operating condition comprises at least one of a pressure on the low side, high side or an intermediate side of the system or a temperature on the high side, low side or intermediate side of the system.

5. The system of claim 1, including at least one valve between each of the sides and the supplemental refrigerant storage container, each valve selectively coupling the storage container with the corresponding side of the system.

6. The system of claim 1, including a first storage container selectively coupled with at least the high pressure side and a second storage container selectively coupled with at least the low pressure side.

7. The system of claim 1, including a pressure regulating device associated with the storage container for controlling an amount of pressure within the storage container.

8. The system of claim 7, wherein the pressure regulating device comprises a heater that selectively alters a temperature within the storage container.

9. The system of claim 1, wherein the operating condition comprises at least one temperature associated with the system.

10. A refrigerant system, comprising:

at least one fluid conduit on a high pressure side of the system;

at least one fluid conduit on a low pressure side of the system;

at least one supplemental refrigerant storage container that selectively receives refrigerant from or provides refrigerant to a selected side of the system; and a controller that determines at least one operating condition associated with the system and uses the determined operating condition for automatically controlling a transfer of refrigerant between the storage container and a selected one of the sides of the system; and wherein the controller determines a desired pressure in the system corresponding to a determined ambient or indoor temperature and causes refrigerant to be transferred between the supplemental refrigerant storage container and a selected one of the sides of the system when a difference between a current system pressure and the desired pressure exceeds a selected threshold.

11. A method of controlling an amount of refrigerant in a refrigerant system, comprising:

providing at least one supplemental refrigerant storage container and a controller; and using the controller for determining at least one operating condition associated with the system including determining at least one of an ambient temperature or an indoor temperature and automatically selectively transferring refrigerant between the supplemental refrigerant storage container and the system, using the determined operating condition to determine a desired amount of transferred refrigerant.

12. The method of claim 11, including determining when the operating condition is not within a desired range and transferring refrigerant from the system to the storage container in an amount corresponding to bringing the condition within the system closer to the desired range.

13. The method of claim 12, wherein the operating condition comprises at least one of a pressure or a temperature on a low, high or intermediate side of the system.

14. The method of claim 12, including transferring refrigerant from a high pressure side of the system to the storage container.

15. The method of claim 11, including determining when a pressure within the system is below a desired level and transferring refrigerant from the storage container to the system in an amount corresponding to bringing the pressure within the system closer to the desired level.

16. The method of claim 15, including transferring refrigerant from the storage container to a low pressure side of the system.

17. The method of claim 11, including determining at least one operating condition in the system corresponding to the determined ambient temperature and transferring refrigerant between the storage container and the system when a difference between the current operating condition and the desired operating condition exceeds a selected threshold.

18. The method of claim 11, including selectively controlling a pressure of refrigerant in the storage container.

19. The method of claim 11, including determining at least one temperature associated with the system.

20. A method of controlling an amount of refrigerant in a refrigerant system, comprising:

providing at least one supplemental refrigerant storage container and a controller; and using the controller for determining at least one operating condition associated with the system and automatically selectively transferring refrigerant between the supplemental refrigerant storage container and the system, using the determined operating condition to determine a desired amount of transferred refrigerant, including determining at least one temperature associated with the system; and determining at least one operating condition in the system corresponding to the determined temperature and transferring refrigerant between the storage container and the system when a difference between the determined operating condition and the desired operating condition exceeds a selected threshold.

21. A refrigerant system, comprising:

at least one fluid conduit on a high pressure side of the system;

at least one fluid conduit on a low pressure side of the system;

at least one supplemental refrigerant storage container that selectively receives refrigerant from or provides refrigerant to a selected side of the system, the supplemental refrigerant storage container comprising a first storage container selectively coupled with at least the high pressure side and a second storage container selectively coupled with at least the low pressure side; and a controller that automatically controls a transfer of refrigerant between the storage container and a selected one of the sides of the system.

* * * * *